US011572706B2

(12) United States Patent
Qiu

(10) Patent No.: US 11,572,706 B2
(45) Date of Patent: Feb. 7, 2023

(54) HANDLE-LOCKING MECHANISM AND DOOR LOCK USING SUCH MECHANISM

(71) Applicant: CMECH (GUANGZHOU) LTD., Guangdong (CN)

(72) Inventor: Jia Sen Qiu, Guangdong (CN)

(73) Assignee: CMECH (GUANGZHOU) LTD., Guangdong (CN)

( * ) Notice: Subject to any disclaimer, the term of this patent is extended or adjusted under 35 U.S.C. 154(b) by 134 days.

(21) Appl. No.: 17/249,308

(22) Filed: Feb. 26, 2021

(65) Prior Publication Data

US 2022/0010589 A1 Jan. 13, 2022

(30) Foreign Application Priority Data

Jul. 1, 2020 (CN) ..... 202010619727.3
Jul. 1, 2020 (CN) ..... 202010622272.0
(Continued)

(51) Int. Cl.
*E05B 13/00* (2006.01)
*E05C 9/04* (2006.01)
(Continued)

(52) U.S. Cl.
CPC ..... *E05B 13/004* (2013.01); *E05B 1/003* (2013.01); *E05B 3/003* (2013.01); *E05B 15/04* (2013.01);
(Continued)

(58) Field of Classification Search
CPC ..... Y10T 292/0836; Y10T 292/0834; Y10T 292/0843; Y10T 292/0848;
(Continued)

(56) References Cited

U.S. PATENT DOCUMENTS 1,237,794 A * 8/1917 Liberman ..... E05B 65/0003 292/153
2,361,734 A 10/1944 Baume
(Continued)

FOREIGN PATENT DOCUMENTS

AU 633318 11/1990
AU 2004203232 A1 2/2005
(Continued)

OTHER PUBLICATIONS

ESPACENET machine translation claims and description of FR 3028547 A1 performed Sep. 27, 2022 (Year: 2014).*

*Primary Examiner* — Christine M Mills
*Assistant Examiner* — Steven A Tullia
(74) *Attorney, Agent, or Firm* — McKee, Voorhees & Sease, PLC

(57) ABSTRACT

A handle-locking mechanism for a door comprises a sliding bar, a locking member and a rotatable member all inside a lock body, wherein the rotary motion of the rotatable member drives an upper latch and a lower latch to a locking position and unlocking position; the sliding bar is slidably arranged inside the lock body and one end of the sliding bar abuts against the bolt, and the sliding bar is provided with a first elastic element, and the sliding bar is pushed against the elastic force from the first elastic element when the bolt retracts; the locking member is coupled with the sliding bar, and when the bolt stretches out, the locking member is brought by the sliding bar to a position to block the rotary motion of the rotatable member.

7 Claims, 5 Drawing Sheets

(30) Foreign Application Priority Data

Jul. 1, 2020 (CN) ..... 202010622790.2
Sep. 30, 2020 (CN) ..... 202011060664.9

(51) Int. Cl.

| | |
|---|---|
| ***E05B 63/14*** | (2006.01) |
| ***E05B 63/04*** | (2006.01) |
| ***E05C 1/08*** | (2006.01) |
| ***E05B 1/00*** | (2006.01) |
| ***E05B 3/00*** | (2006.01) |
| ***E05B 15/04*** | (2006.01) |
| ***E05B 63/08*** | (2006.01) |

(52) U.S. Cl.
CPC ..... *E05B 63/044* (2013.01); *E05B 63/14* (2013.01); *E05C 1/085* (2013.01); *E05C 9/04* (2013.01); *E05B 63/08* (2013.01); *E05B 63/146* (2013.01); *E05B 2015/0406* (2013.01); *E05Y 2900/132* (2013.01)

(58) Field of Classification Search
CPC ..... Y10T 292/0856; Y10T 70/5226; Y10T 70/523; Y10T 70/5235; Y10T 70/5239; Y10T 70/5243; Y10T 70/55; Y10T 70/5518; E05B 13/004; E05B 63/14; E05B 63/044; E05B 63/08; E05B 63/146; E05B 1/003; E05B 3/003; E05B 15/04; E05B 15/044; E05B 2015/0406; E05C 9/04; E05C 1/085; E05C 9/00; E05Y 2900/132
See application file for complete search history.

(56) References Cited

U.S. PATENT DOCUMENTS

| | | | | |
|---|---|---|---|---|
| 3,390,557 | A | 7/1968 | Erickson et al. | |
| 3,446,524 | A | 5/1969 | Barry | |
| 3,999,411 | A * | 12/1976 | Kambic | E05B 55/00 70/144 |
| 4,893,849 | A | 1/1990 | Schlack | |
| 4,950,005 | A | 8/1990 | Cudd | |
| 5,123,684 | A | 6/1992 | Yeh | |
| 5,301,525 | A | 4/1994 | Doering | |
| 5,495,731 | A | 3/1996 | Riznik | |
| 5,707,090 | A | 1/1998 | Sedley | |
| 5,819,562 | A * | 10/1998 | Christ | E05C 9/025 292/34 |
| 3,045,169 | A | 4/2000 | Frolov | |
| 6,209,883 | B1 | 4/2001 | Kashmerick et al. | |
| 6,209,893 | B1 | 4/2001 | Ferris | |
| 6,209,931 | B1 | 4/2001 | Von Stoutenborough et al. | |
| 6,289,704 | B1 * | 9/2001 | Collet | E05B 63/20 70/134 |
| 6,293,598 | B1 | 9/2001 | Rusiana | |
| 6,349,982 | B2 | 2/2002 | Fayngersh et al. | |
| 6,389,855 | B2 * | 5/2002 | Renz | E05B 65/1086 70/109 |
| 6,393,878 | B1 | 5/2002 | Fayngersh et al. | |
| 6,682,109 | B2 | 1/2004 | Horne et al. | |
| 7,108,300 | B2 | 9/2006 | Hodgin et al. | |
| 8,234,892 | B2 | 8/2012 | Laverty et al. | |
| 8,366,158 | B2 | 2/2013 | Chen | |
| 8,371,627 | B2 | 2/2013 | Chiang et al. | |
| 8,474,884 | B2 | 7/2013 | Helisten et al. | |
| 8,523,247 | B2 * | 9/2013 | Talpe | E05B 17/042 292/51 |
| 8,523,249 | B2 | 9/2013 | Hodgin et al. | |
| 8,540,288 | B2 * | 9/2013 | Tsai | E05C 9/026 292/64 |
| 8,550,506 | B2 | 10/2013 | Nakanishi et al. | |
| 8,702,131 | B1 | 4/2014 | Gianoli et al. | |
| 8,973,416 | B2 * | 3/2015 | Terei | E05B 63/0065 70/105 |
| 2004/0169378 | A1 | 9/2004 | Hodgin et al. | |
| 2005/0092042 | A1 * | 5/2005 | Constantinou | E05C 9/1841 70/107 |
| 2005/0103066 | A1 * | 5/2005 | Botha | E05C 9/047 70/107 |
| 2007/0114800 | A1 | 5/2007 | Kuo | |
| 2008/0042452 | A1 | 2/2008 | Moon et al. | |
| 2009/0282877 | A1 * | 11/2009 | Laverty | E05B 63/0056 70/107 |
| 2011/0210566 | A1 | 9/2011 | Chen | |
| 2012/0000257 | A1 | 1/2012 | Wheeler et al. | |
| 2016/0060905 | A1 * | 3/2016 | Shiu | E05B 59/00 292/33 |
| 2017/0030112 | A1 | 2/2017 | Kane | |
| 2018/0155962 | A1 * | 6/2018 | Mitchell | E05C 9/042 |
| 2022/0010594 | A1 | 1/2022 | Qiu | |

FOREIGN PATENT DOCUMENTS

| | | | | |
|---|---|---|---|---|
| AU | 2004229071 | B2 * | 7/2010 | E05B 59/00 |
| CA | 2254164 | A | 6/1999 | |
| CA | 2254164 | A1 | 6/1999 | |
| CN | 110630113 | A | 12/2019 | |
| CN | 111101764 | A | 5/2020 | |
| DE | 3605826 | A1 * | 2/1986 | E05B 3/065 |
| DE | 4014041 | A1 * | 5/1990 | E05B 63/14 |
| DE | 9321445 | U1 * | 2/1998 | E05B 63/14 |
| DE | 20218956 | U1 * | 2/2003 | E05B 63/14 |
| EP | 0358971 | A2 * | 8/1989 | E05C 9/026 |
| EP | 0454965 | A1 * | 2/1991 | E05B 63/14 |
| EP | 0454958 | A1 | 11/1991 | |
| EP | 0661409 | A2 | 7/1995 | |
| EP | 1091064 | A2 * | 4/2001 | E05C 9/021 |
| EP | 1098057 | B1 | 12/2004 | |
| EP | 1857617 | A2 | 11/2007 | |
| EP | 1865132 | A2 | 12/2007 | |
| EP | 2503080 | A2 | 9/2012 | |
| EP | 3438384 | A1 * | 2/2019 | E05B 59/00 |
| FR | 2836505 | A1 * | 8/2003 | E05C 9/042 |
| FR | 3028547 | A1 * | 5/2016 | E05B 3/065 |
| GB | 550024 | A | 12/1942 | |
| GB | 631343 | A | 11/1949 | |
| GB | 1246441 | A | 9/1971 | |
| GB | 1462351 | A | 1/1977 | |
| GB | 2119014 | A * | 11/1983 | E05C 9/02 |
| GB | 2202267 | A | 9/1988 | |
| GB | 2268221 | A | 5/1994 | |
| GB | 2424035 | A | 9/2006 | |
| KR | 101876126 | B1 * | 4/2017 | E05C 9/042 |
| WO | 9961734 | A2 | 12/1999 | |
| WO | WO-02072985 | A1 * | 9/2002 | E05B 13/004 |
| WO | WO-2008094472 | A2 * | 8/2008 | E05B 63/0017 |
| WO | 2008124874 | A1 | 10/2008 | |
| WO | WO-2015058253 | A1 * | 4/2015 | E05B 13/004 |
| WO | 2019033147 | A1 | 2/2019 | |

* cited by examiner

HANDLE-LOCKING MECHANISM AND DOOR LOCK USING SUCH MECHANISM

PRIORITY CLAIMS AND INCORPORATION OF RELATED APPLICATIONS

This application claims priority to the following four Chinese applications, and incorporate by reference their related pending U.S. applications in their entireties:

(A) Chinese application 202010619727.3, filed Jul. 1, 2020;

(B) Chinese application 202010622272.0, filed Jul. 1, 2020 and U.S. Ser. No. 17/249,314, filed Feb. 26, 2021, MVS Ref No. P13399US00;

(C) Chinese application 202011060664.9, filed Sep. 30, 2020, and U.S. Ser. No. 17/249,326, filed Feb. 26, 2021, MVS Ref No. P13401US00; and (D) Chinese application 202010622790.2, filed Jul. 1, 2020, and U.S. Ser. No. 17/249,299, filed Feb. 26, 2021, MVS Ref No. P13437US00.

FIELD OF THE INVENTION

The following relates to the field of lockset, and more particularly to a handle-locking mechanism and a door lock using such mechanism.

BACKGROUND OF THE INVENTION

A multipoint lock is a door lock having multiple bolts or latches locking a door, and works in the following principle: for opening the door, use a key to unlock the lock cylinder from outside the door or turn a thumb knob on the inside of the door, and thereby retract the deadbolt, and then rotate the handle downwardly to a certain angle, and thereby retract the latch bolt while the upper and the lower shootbolt latches are retracted, thus the door can be opened. Subsequently, upon release of the handle, then the latch bolt extends, and the handle can be released to restore to its original position. For locking the door, rotate the handle upwardly to a certain angle, and the upper and the lower shootbolt latches extend, then lock the lock cylinder using a key or a thumb-turn knob, and thereby extend the deadbolt, thus the door is locked. Subsequently the handle is released and restored to its original position. Due to the fact that the door is locked by the upper and the lower shootbolt latches, the deadbolt and the latch bolt at the same time, safety is greatly improved.

However, in prior art, the handle may possibly swing down from the origin position when the multipoint lock was locked, such that the multipoint lock may be unlocked by unintentionally moving the handle during the practical use, resulting in the poor security protection and anti-theft performance of the door lock, and it is more likely to cause damage to the door lock.

SUMMARY OF THE INVENTION

It is an objective of the invention to provide a handle-locking mechanism and a door lock using such mechanism to solve the problems above. The handle-locking mechanism and a door lock using such mechanism according to the present invention can ensure a locking state of the upper and the lower latches effectively while locking up the door, thereby improving the security property of door lock and the operation experience.

The objective is achieved by the following technical solutions:

A handle-locking mechanism is provided on a door, and comprises a sliding bar, a locking member and a rotatable member all inside a lock body, wherein the rotary motion of the rotatable member drives an upper shootbolt latch and a lower shootbolt latch to a locking position and unlocking position;

the sliding bar is slidably arranged inside the lock body and one end of the sliding bar abuts against a deadbolt, and the sliding bar is provided with a first elastic element, and the sliding bar is pushed against the elastic force from the first elastic element when the deadbolt retracts;

the locking member is coupled with the sliding bar, when the deadbolt extends, the locking member is brought by the sliding bar to a position to block the rotary motion of the rotatable member.

Preferably, an inclined guiding surface is configured in the contacting area of the sliding bar facing to the deadbolt.

Preferably, the locking member comprises a first arm and a second arm which both are connected at a certain angle, wherein a locating post is configured at the joint of the first arm and the second arm, such that the locking member is pivoted around the locating post in the lock body.

Preferably, the sliding bar is provided with a pair of limiting posts which form a space therebetween; the first arm of the locking member is stuck into the space, such that the locking member is pivoted following the sliding motion of the sliding bar.

Preferably, a protrusion is provided on the rotatable member, when the first elastic element is in its natural state, the second arm is pivoted to a position below the rotary path of the protrusion and abuts against the protrusion.

Preferably, when the first elastic member is in its natural state, the direction of the second arm is tangent to the rotary path of the protrusion.

Preferably, the rotatable member comprises a rotatable portion, and a second elastic element is provided between the rotatable portion and the lock body for restoring the rotatable portion to its origin position after being rotated.

Preferably, the rotatable portion is provided with a hole for mounting a handle, and the hole is configured in the shape of a polygon or an oval.

Preferably, the rotatable portion is configured with a groove for receiving the second elastic element, a first slot and a second slot, wherein the first slot and the second slot are arranged offset from each other and are in communication with the groove respectively; the two ends of the second elastic element extend across the first slot and the second slot respectively and each abuts against the corresponding side of a retaining member of the lock body.

Further provides a door lock, comprising the above described handle-locking mechanism.

As compared with the prior art, the present invention has following technical advantages:

The present invention arranges a sliding bar and a locking member, allowing the rotatable member to drive the upper and the lower shootbolt latches to extend during the locking operation, for example, during upward rotation of the handle. During locking operation, the dead bolt is extended, such that the first elastic element restores to its natural state and force the sliding bar upwardly to abut the locking member against the rotatable member, thereby preventing the handle from being rotated downwardly; in this way, the upper and the lower latches will not be unlocked by unintentionally moving the handle while the door is locked, ensuring the security of using door lock. In addition, the anti-theft performance is also greatly improved because the handle cannot be rotated downward when the deadbolt is extended. The operation experience for the users is further improved as well. The present invention achieves a reliable and effective locking protection for the handle through the interactions between components arranged in a compact and ingenious configuration, which is easy to operate and adapt for wide application.

BRIEF DESCRIPTION OF THE DRAWINGS

The present invention will be described hereinafter in details with reference to the figures and the embodiments for the sake of better understanding. Any non-substantive, obvious alterations or improvement by the technician of this technical field according to the present invention may be incorporated into ambit of the claims of the present invention.

LIST OF REFERENCE CHARACTERS

Figure 1:
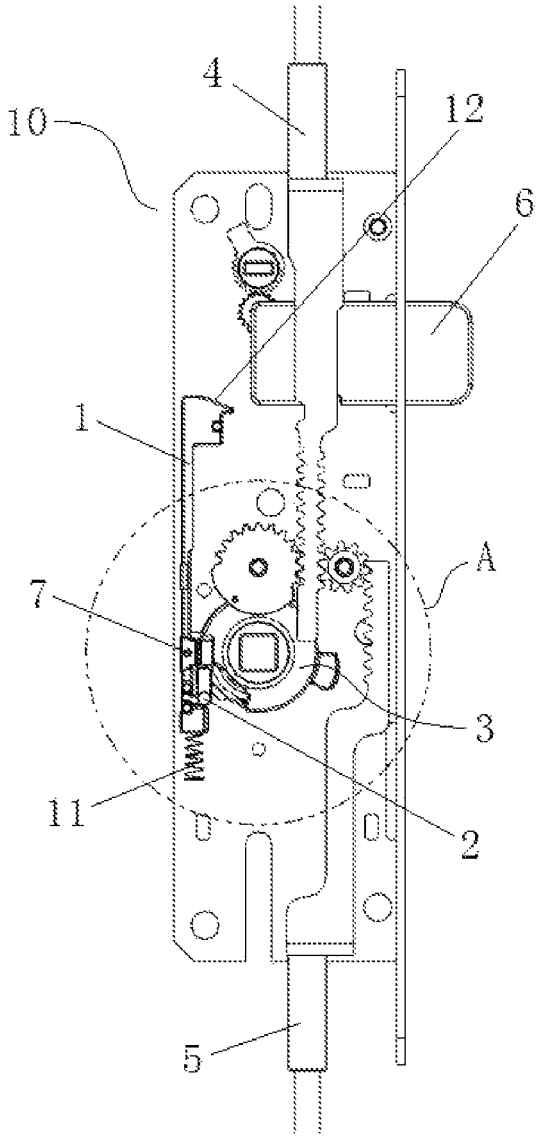
FIG. 1 illustrates an internal structure of the door lock being locked according to the present invention.

10 Lock body
1 Sliding bar
11 First elastic element
12 Guiding surface
13 Limiting post
2 Locking member
21 First arm portion
22 Second arm portion
23 Locating post
3 Rotatable member
31 Protrusion
32 Rotatable portion
321 Hole
322 Groove
323 First slot
324 Second slot
33 Second elastic element
4 Upper latch
5 Lower latch
6 Deadbolt
7 Retaining member

DETAILED DESCRIPTION OF THE PREFERRED EMBODIMENTS

The present invention will be described hereinafter in details with reference to the figures and the embodiments for the sake of clarity. It should be noted that the embodiments of the present invention and the features in different embodiments may be combined if they are not conflicted with each other. Although certain embodiments are described in detail for a better understanding, it should be understood that there may be more embodiments. Various changes and modifications may be made by those skilled in the art on the basis of the present invention without creative works and without departing from the scope of the claims.

The technical terms used herein have the general meanings well understood by those skilled in the art unless otherwise defined. The terms in the description of the present invention have been presented for purposes of illustrating the embodiments, not limiting the present invention.

Embodiment

Figure 2:
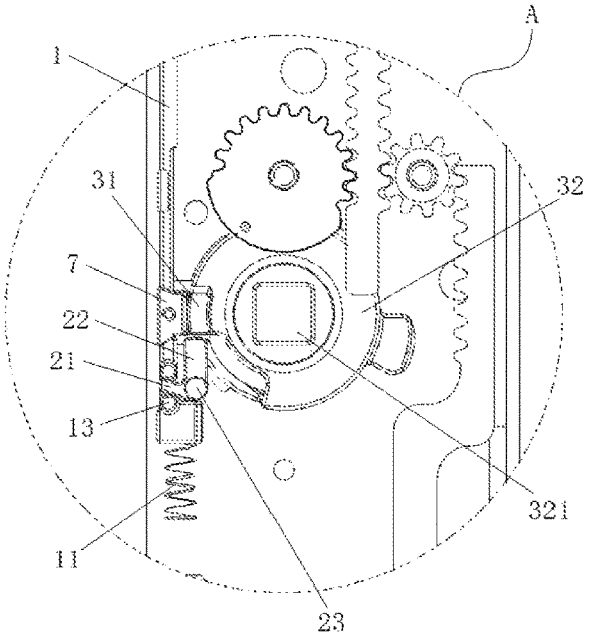
FIG. 2 illustrates an enlarged part A of FIG. 1.
Figure 3:
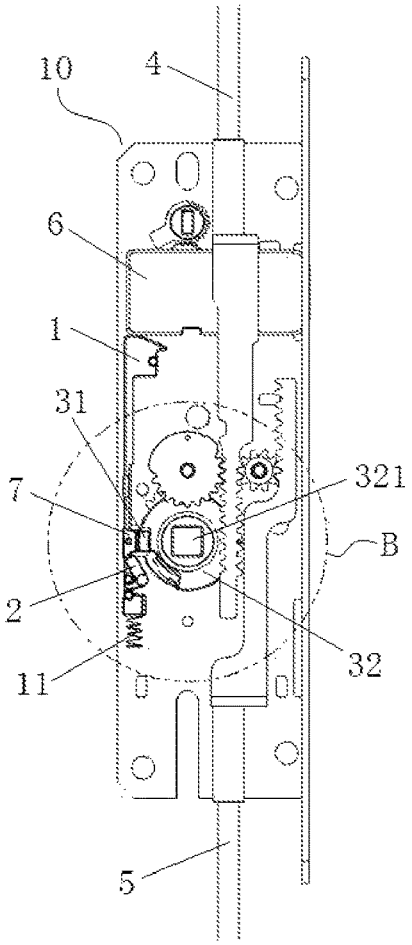
FIG. 3 illustrates an internal structure of the door lock being unlocked according to the present invention.
Figure 4:
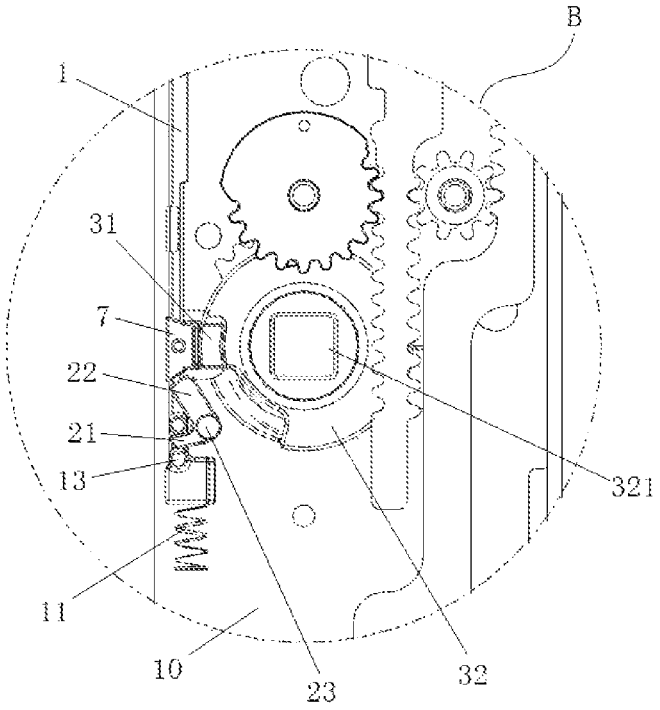
FIG. 4 illustrates an enlarged part B of FIG. 3.
Figure 5:
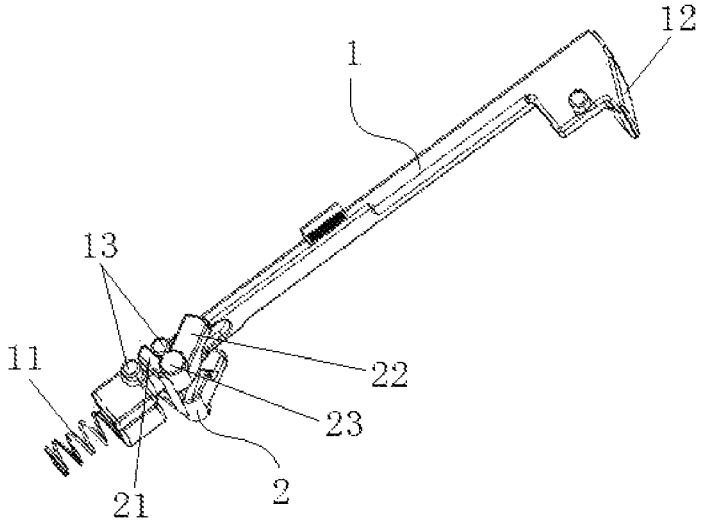
FIG. 5 illustrates a sliding bar being connected with a locking member according to the present invention.
Figure 6:
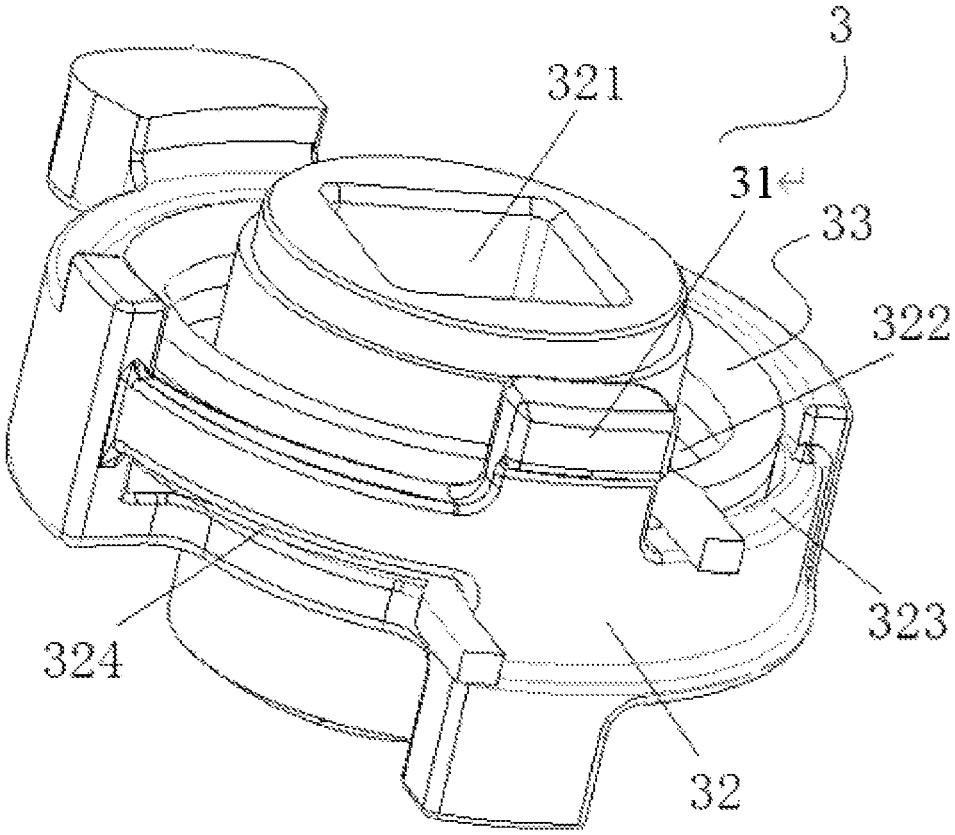
FIG. 6 illustrates the rotatable member according to the present invention.
Figure 7:
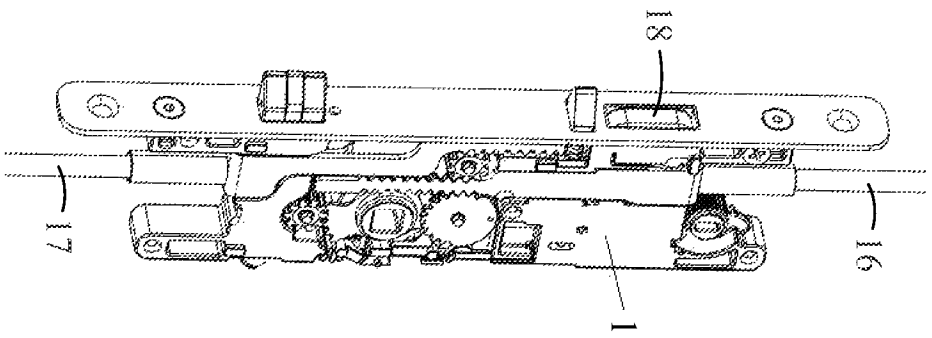
FIG. 7 is a perspective view of the lock body and components of the present invention.

As shown in FIGS. 1 to 7, this embodiment provides a handle-locking mechanism, comprising a sliding bar 1, a locking member 2, and a rotatable member 3, all of which are arranged inside a lock body 10 of a door lock, such as a multi-point door lock assembly. The rotatable member 3 is coupled to an upper shootbolt latch 4 and a lower shootbolt latch 5 in the lock body 10 via a transmission mechanism, such that rotary motion of the rotatable member 3 is transformed into the linear motion of the upper latch 4 and the lower latch 5 to achieve locking and unlocking.

The sliding bar 1 is slidably arranged inside the lock body 10, where one end of the sliding bar 1 abuts against a bolt 6. The sliding bar 1 is provided with a first elastic element 11. When the bolt 6 retracts, the sliding bar 1 is pushed downwardly against the elastic force from the first elastic element 11.

In this embodiment, the bolt 6 of the lock body 10 is a deadbolt. One end of the sliding bar 1 contacts with the deadbolt, while the first elastic element 11 is provided at the other end of the sliding bar 1. The first elastic element 11 preferably is a compression spring. In another alternative embodiment, it is also possible that the first elastic element 11 is provided at the end of the sliding bar 1 which contacts with the deadbolt, in this case, the first elastic element 11 is a tension spring.

In a preferred embodiment, an inclined guiding surface 12 is configured in the contacting area of the sliding bar 1 facing to the bolt 6, such that the retraction of the bolt 6 can press the sliding bar 1 down smoothly. In this embodiment, the guiding surface 12 is provided on the end of the sliding bar 1, however, it is also possible that the guiding surface 12 is provided on the bolt 6.

The locking member 2 is coupled with the sliding bar 1. When the bolt 6 is extended, the first elastic element 11 restores its natural state and forces the sliding bar 1 to move upwardly, and the locking member 2 therefore moves to a position to block the rotary motion of the rotatable member 3.

In a preferred embodiment, the locking member 2 has a cross-section in the shape of a "L" or "V", consisting of a first arm 21 and a second arm 22 which both are connected at a certain angle, wherein a locating post 23 is configured at the joint of the first arm 21 and the second arm 22, such that the locking member 2 can be pivoted around the locating post 23 in the lock body 10.

In addition, the sliding bar 1 is provided with a pair of limiting posts 13 which form a space therebetween. The first arm 21 of the locking member 2 is received into the space, such that the locking member 2 can be pivoted following the sliding motion of the sliding bar 1. Specifically, a protrusion 31 is provided on the rotatable member 3, when the first elastic element 11 is in its natural state, the sliding bar 1 drives the locking member 2 to pivotally move, allowing the second arm 22 to pivot to a position below the rotary path of the protrusion 31, and abuts against the protrusion 31 to prevent the rotatable member 3 from rotating. In this embodiment, each limiting post 13 is a cylinder for better movement between the sliding bar 1 and the locking member 2.

As a preferred embodiment, when the first elastic member 11 is in its natural state, the direction of the second arm 22 is tangent to the rotary path of the protrusion 31, in order to further improve the locking protection for the rotatable member 3, in case the handle is under too much pressure, causing the locking member 2 to pivot reversely to force the sliding bar 1 to a unlock position. Therefore, the reliability of the mechanism is further improved, and the life time of the parts are prolonged as mis-operation is avoided.

Further, the rotatable member 3 comprises a rotatable portion 32 where the protrusion 31 is arranged. The rotatable portion 32 is provided with a hole 321 for mounting the door handle. In this embodiment, the hole 321 is preferably configured in the shape of a polygon, however, it is also possible that the hole 321 has a cross-section in the shape of an oval in practical use, in order to effectively prevent the handle from sliding, and achieve a more simplified structure.

A second elastic element 33 is provided between the rotatable portion 32 and the lock body 10 for restoring the rotatable portion 32 to its origin position after being rotated. The rotatable portion 32 is configured with a groove 322 for receiving the second elastic element 33, a first slot 323, and a second slot 324, wherein the first slot 323 and the second slot 324 are arranged offset from each other and are in communication with the groove 322 respectively. In this embodiment, the second elastic element 33 is a torsional spring. The two ends of the second elastic element 33 extend across the first slot 323 and the second slot 324 respectively and each abuts against the corresponding side of a retaining member 7 of the lock body 10.

Further provided is a door lock in this embodiment according to the present invention, comprising the lock body 10 and the above described handle-locking mechanism.

It should be noted that, the rest structure of the door lock according to the present invention may be those disclosed already in prior art and will not be described in details herein.

The embodiment described hereinbefore is merely preferred embodiment of the present invention and not for purposes of any restrictions or limitations on the invention. It will be apparent that any non-substantive, obvious alterations or improvement by the technician of this technical field according to the present invention may be incorporated into ambit of the claims of the present invention.

What is claimed is:

1. A handle-locking mechanism for a door, comprising a sliding bar, a locking member and a rotatable member all inside a lock body, wherein rotary motion of the rotatable member drives an upper latch and a lower latch between a locking position and an unlocking position;

the sliding bar being slidably arranged inside the lock body and one end of the sliding bar abutting against a bolt, and the sliding bar engaging a first elastic element, and the sliding bar pushing against the elastic force from the first elastic element when the bolt retracts;

the locking member is coupled with the sliding bar, and when the bolt extends, the locking member is brought by the sliding bar to a position to block the rotary motion of the rotatable member;

the rotatable member comprising a rotatable portion, and a second elastic element is provided between the rotatable portion and the lock body for restoring the rotatable portion to its origin position after being rotated; and the rotatable portion being configured with a groove for receiving the second elastic element, a first slot and a second slot, wherein the first slot and the second slot are arranged offset from each other and are in communication with the groove respectively; and two ends of the second elastic element extend across the first slot and the second slot, respectively, and each end abuts against a corresponding side of a retaining member of the lock body.

2. The handle-locking mechanism according to claim 1, wherein an inclined guiding surface is configured in an area of contact between the sliding bar and the bolt.

3. The handle-locking mechanism according to claim 1, wherein the locking member comprises a first arm and a second arm which both are angularly connected at a joint, wherein a locating post is configured at the joint of the first arm and the second arm, such that the locking member is pivoted around the locating post in the lock body.

4. The handle-locking mechanism according to claim 3, wherein the sliding bar is provided with a pair of limiting posts which form a space therebetween, and the first arm of the locking member is received into the space, such that the locking member is pivoted during the sliding motion of the sliding bar.

5. The handle-locking mechanism according to claim 4, wherein a protrusion is provided on the rotatable member, and when the first elastic element is in its natural state, the second arm pivoting to a position below a rotary path of the protrusion and abuts against the protrusion.

6. The handle-locking mechanism according to claim 5, wherein, when the first elastic member is in its natural state, the direction of the second arm is tangent to the rotary path of the protrusion.

7. The handle-locking mechanism according to claim 1, wherein the rotatable portion is provided with a hole for mounting a handle, and the hole is configured in the shape of a polygon or an oval.

* * * * *